US010357889B2

(12) United States Patent
Odagiri et al.

(10) Patent No.: US 10,357,889 B2
(45) Date of Patent: Jul. 23, 2019

(54) INNER BLADE OF ROTARY ELECTRIC SHAVER

(71) Applicant: IZUMI PRODUCTS COMPANY, Matsumoto-shi, Nagano (JP)

(72) Inventors: Koichi Odagiri, Matsumoto (JP); Yoshiyuki Mimura, Matsumoto (JP)

(73) Assignee: IZUMI PRODUCTS COMPANY, Nagano (JP)

( * ) Notice: Subject to any disclaimer, the term of this patent is extended or adjusted under 35 U.S.C. 154(b) by 73 days.

(21) Appl. No.: 15/538,235

(22) PCT Filed: Feb. 24, 2015

(86) PCT No.: PCT/JP2015/055193
§ 371 (c)(1),
(2) Date: Jun. 21, 2017

(87) PCT Pub. No.: WO2016/135845
PCT Pub. Date: Sep. 1, 2016

(65) Prior Publication Data
US 2018/0015621 A1 Jan. 18, 2018

(51) Int. Cl.
*B26B 19/14* (2006.01)
*B26B 19/38* (2006.01)

(52) U.S. Cl.
CPC ..... *B26B 19/141* (2013.01); *B26B 19/3893* (2013.01)

(58) Field of Classification Search
CPC ..... B26B 19/141; B26B 19/3893
See application file for complete search history.

(56) References Cited

U.S. PATENT DOCUMENTS 2,824,367 A * 2/1958 McWilliams ..... B26B 19/14 30/34.2
8,397,604 B2 * 3/2013 Akkerman ..... B21D 53/64 30/436

(Continued)

FOREIGN PATENT DOCUMENTS

CN 201728671 U 2/2011
CN 102284963 A 12/2011

(Continued)

OTHER PUBLICATIONS

International Search Report, issued in PCT/JP2015/055193 (PCT/ISA/210), dated May 19, 2015.

*Primary Examiner* — Hwei-Siu C Payer
(74) *Attorney, Agent, or Firm* — Birch, Stewart, Kolasch & Birch, LLP

(57) ABSTRACT

An inner blade of a rotary electric shaver decreases a rake angle and increases an erecting angle in a small blade, which can prevent remaining hair from appearing on one end side in a cross section of hair, and which can prevent poor shaving performance and increased sliding resistance against an outer blade. An inner blade of a rotary electric shaver includes an outer blade whose upper surface functions as an annular shaving surface having multiple hair inlets, and the inner blade having a plurality of small blades which rotate while coming into sliding contact with a lower surface of the outer blade. The small blade is formed by erecting a portion of a metal plate so that an angle of a front side in a rotation direction with respect to a plate surface of the metal plate becomes an acute angle, the front side in the rotation direction has a concave portion having a shape hollowed toward a lower end portion from an upper end surface which comes into sliding contact with the outer (Continued)

blade, and an upper end edge defined by the upper end surface and the concave portion functions as a blade edge.

4 Claims, 8 Drawing Sheets

(56) References Cited

U.S. PATENT DOCUMENTS

| | | | | |
|---|---|---|---|---|
| 8,434,233 | B2 * | 5/2013 | Okabe | B26B 19/141 30/346.51 |
| 9,789,616 | B2 * | 10/2017 | Mimura | B26B 19/141 |
| 2007/0113408 | A1 | 5/2007 | Okabe | |
| 2008/0028618 | A1 | 2/2008 | Okabe | |
| 2018/0015621 | A1 * | 1/2018 | Odagiri | B26B 19/141 |

FOREIGN PATENT DOCUMENTS

| | | | | |
|---|---|---|---|---|
| CN | 202964699 | U | | 6/2013 |
| EP | 2 602 071 | A1 | | 6/2013 |
| JP | 44-9719 | Y1 | | 4/1969 |
| JP | 54-33893 | | | 3/1979 |
| JP | 2-60683 | A | | 3/1990 |
| JP | 2007-135991 | A | | 6/2007 |
| JP | 2008-36092 | A | | 2/2008 |
| JP | 2015-71002 | A | * | 4/2015 |
| JP | 2017-185371 | A | * | 10/2017 |

* cited by examiner

INNER BLADE OF ROTARY ELECTRIC SHAVER

TECHNICAL FIELD

The present invention relates to an inner blade of a rotary electric shaver.

BACKGROUND ART

For example, PTL 1 discloses a known rotary electric shaver that has an outer blade whose upper surface functions as an annular shaving surface having multiple hair inlets, and an inner blade having a small blade which rotates while coming into sliding contact with a lower surface of the outer blade from below of the shaving surface. In this invention, examples of the hair include beards, mustaches, whiskers, and the like.

CITATION LIST

Patent Literature

PTL 1: JP-A-2007-135991

SUMMARY OF INVENTION

Technical Problem

Here, FIG. 8A illustrates a configuration example of an inner blade 142 and an outer blade 122 of a rotary electric shaver in the related art disclosed in PTL 1, and a state where hair X is cut. FIG. 8B illustrates a state of the hair X cut by the inner blade 142. As illustrated in FIG. 8A, when a small blade 142A of the inner blade 142 cuts the hair X which enters a hair inlet of the outer blade 122, the hair X is pushed by a lower wall of a blade edge 142*b*, and is brought into a state where the hair X is pushed up at an angle θ. As a result, as illustrated in FIG. 8B, there is a problem in that remaining hair Xa is likely to appear on one end side of a cross section of the cut hair X. An arrow in the drawing indicates a rotation direction of the inner blade 142.

In order to solve the problem, it is necessary to decrease the angle θ. For example, as in an inner blade 242 according to a first comparative example illustrated in FIG. 9, it is possible to decrease an angle (hereinafter, referred to as a "rake angle") β of a blade edge 242*b* of the small blade 242A by decreasing an angle (hereinafter, referred to as an "erecting angle") α for erecting a small blade 242A from a plate surface 242B. As a result, it is possible to obtain an advantageous effect that the angle θ can be decreased.

However, if a configuration having the small erecting angle α is required, a length L3 of the small blade 242A is inevitably lengthened. As a result, rigidity of the small blade 242A becomes poor, thereby causing deflection or generating vibrations. A close contact state of an outer blade 222 is hindered. Thus, the hair cannot be sufficiently captured, and deep shaving is not available. In addition, a problem arises in that the hair is pulled and shaving comfortability becomes worse. On the other hand, if the length L3 of the small blade 242A is configured to be shortened, a height H3 of the small blade 242A has to be lowered. As a result, a problem arises in that a clearance cannot be sufficiently ensured. In addition to these problems, an area of a sliding surface of the outer blade 222 formed on an upper end surface 242*a* of the small blade 242A increases, thereby increasing sliding resistance. Consequently, a problem arises in that noise (sliding sound) or power consumption increases. In view of these problems, it is necessary to set the erecting angle α to be large within a range up to 90° without decreasing the erecting angle α.

In this way, the inner blade of the rotary electric shaver simultaneously demands both a configuration for decreasing the rake angle β and a configuration for increasing the erecting angle α, thereby resulting in a conflicting problem.

The present invention is made in view of the above-described circumstances, and an object thereof is to provide an inner blade of a rotary electric shaver which can solve a conflicting problem of decreasing the rake angle β and increasing the erecting angle α in the small blade, which can prevent remaining hair from appearing on one end side of a cross section of hair, and which can prevent poor shaving performance and increased sliding resistance against an outer blade.

Solution to Problem

As an embodiment, the problems are solved by solving means disclosed below.

According to this disclosure, there is provided an inner blade of a rotary electric shaver which includes an outer blade whose upper surface functions as an annular shaving surface having multiple hair inlets, and the inner blade having a plurality of small blades which rotate while coming into sliding contact with a lower surface of the outer blade. The small blade is formed by erecting a portion of a metal plate so that an angle α of a front side in a rotation direction with respect to a plate surface of the metal plate becomes an acute angle, the front side in the rotation direction has a concave portion having a shape hollowed toward a lower end portion from an upper end surface which comes into sliding contact with the outer blade, and an upper end edge defined by the upper end surface and the concave portion functions as a blade edge.

Advantageous Effects of Invention

According to the inner blade of the disclosed rotary electric shaver, it is possible to solve a conflicting problem of decreasing the rake angle β and increasing the erecting angle α in the small blade. In this manner, it is possible to prevent remaining hair from appearing on one end side of the cross section of the hair, therefore, it is possible to prevent poor shaving performance, and it is possible to decrease sliding resistance against the outer blade.

DESCRIPTION OF EMBODIMENTS

First Embodiment

Figure 1:
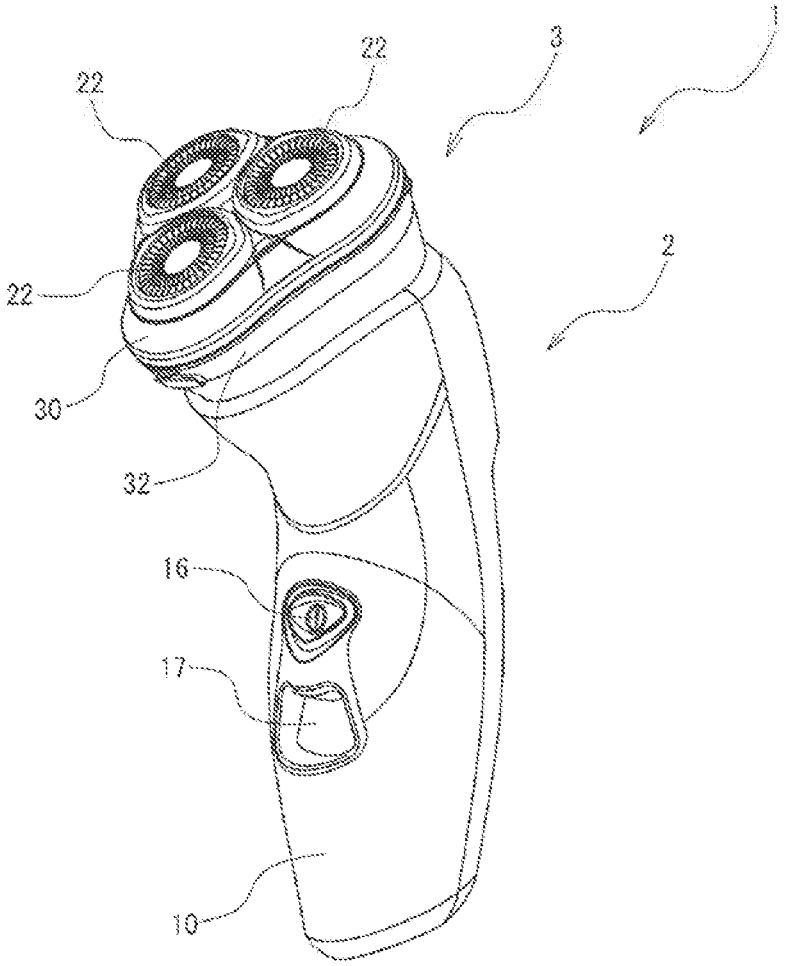
FIG. 1 is a schematic view (perspective view) illustrating an example of a rotary electric shaver according to an embodiment of the present invention.
Figure 2:
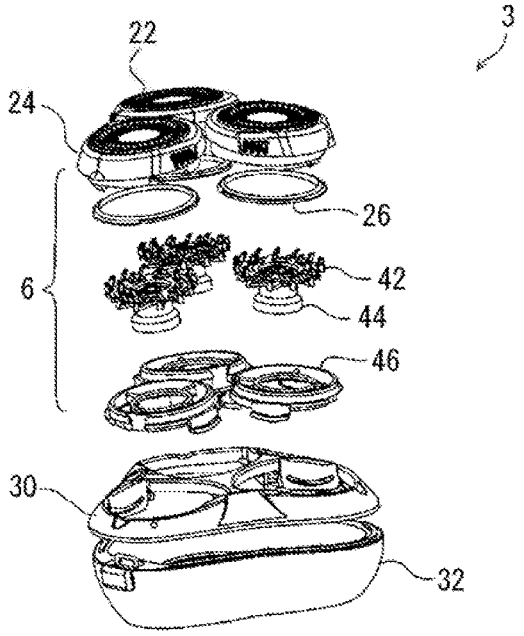
FIG. 2 is a schematic view (exploded perspective view) illustrating an example of a head unit of the rotary electric shaver illustrated in FIG. 1.

Hereinafter, a first embodiment according to the present invention will be described in detail with reference to the drawings. FIG. 1 is a schematic view (perspective view) illustrating an example of a rotary electric shaver 1 according to the present embodiment. In addition, FIG. 2 is a schematic view (exploded perspective view) illustrating an example of a head unit 3 of the rotary electric shaver 1. In all of the drawings for describing embodiments, the same reference numerals will be given to members having the same function, and repeated description thereof may be omitted in some cases.

As illustrated in FIGS. 1 and 2, the rotary electric shaver 1 according to the present embodiment has an outer blade 22 whose upper surface functions as an annular shaving surface having multiple hair inlets, and an inner blade 42 having a small blade which rotates while coming into sliding contact with a lower surface of the outer blade 22. The rotary electric shaver cuts hair entering the hair inlets by using the outer blade 22 and the inner blade 42. The rotary electric shaver having three sets of blade unit 6 configured to include the outer blade 22 and the inner blade 42 will be described as an example. However, the present invention is not limited thereto.

The reference numeral 2 in FIG. 1 represents a main body which includes a substantially cylindrical case 10. The case 10 internally accommodates a battery, a motor, and a control circuit board (all are not illustrated). A power switch 16 is attached to a front surface of the case 10, and a display unit 17 having an LED lamp for indicating residual capacity or an operation state of the battery is disposed below the power switch.

As illustrated in FIG. 2, the head unit 3 includes a head case 32 which is held by being connected to an upper portion of the case 10 of the main body 2, a blade frame 30 which is covered with the head case 32 from above, a drive mechanism (not illustrated) accommodated in an inner bottom portion of the head case 32, and three sets of blade unit 6 which are held by the blade frame 30 so as to be capable of slightly upward and downward movement and oscillating movement. Here, each blade unit 6 includes the outer blade 22 having a substantially disc shape, and the inner blade 42 which rotates while coming into sliding contact with a lower surface (inner surface) of the outer blade 22. In addition, the three sets of blade unit 6 are arranged so as to form a triangular shape in a plan view. As described above, a case where the present embodiment employs the three sets of blade unit 6 will be described as an example. However, even in a case where the number of sets of the blade unit is not three, it may be considered that the same configuration is applied to the case.

Here, the outer blade 22 has multiple radial slits on the upper surface of the outer blade 22, and is configured so that the inner blade 42 cuts the hair entering the slits. The outer blade 22 has a shape whose peripheral edge is bent downward, and an outer blade ring 24 is fitted to the peripheral edge. A stopper ring 26 is fitted to an inner periphery of the outer blade ring 24, thereby fixing the outer blade 22 to the outer blade ring 24.

On the other hand, the inner blade 42 is fixed to an inner blade holder 44, and a concave portion to which an upper end of an inner blade drive shaft (not illustrated) is fitted is formed in a lower portion of the inner blade holder 44. The inner blade 42 is held so as to be capable of oscillating movement to the outer blade 22 side by an inner blade rest 46 fitted to the outer blade ring 24, thereby forming the three sets of independent blade unit 6.

The blade units 6 are combined with each other while being provided with the above-described configuration. In this manner, the upper end surfaces 42*a* of the small blades 42A of the inner blade 42 are respectively brought into contact with the lower surface 22*b* of the outer blade 22. In this state, the inner blade 42 is rotatably driven, thereby enabling the hair entering the hair inlets to be cut by a blade edge (upper end edge 42*b* of the small blade 42A of the inner blade 42, to be described later) of the inner blade (refer to FIGS. 4A and 4B to be described later).

Figure 3:
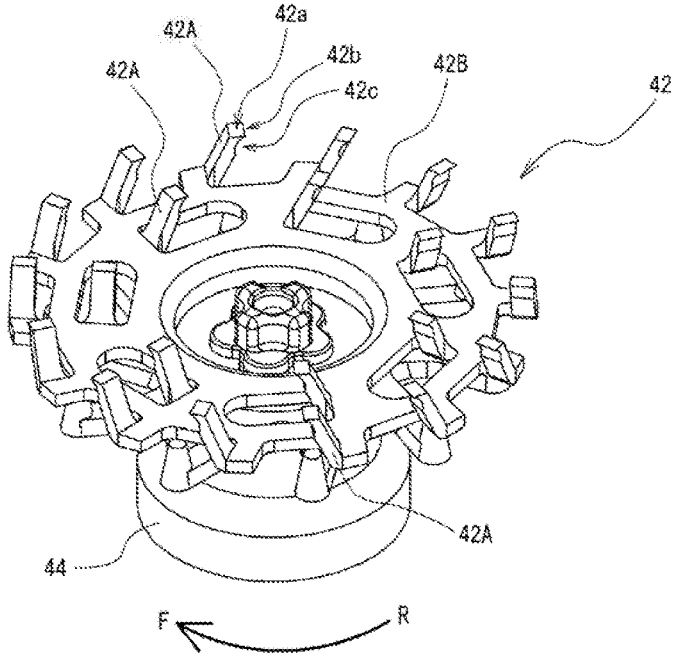
FIG. 3 is a schematic view illustrating a first embodiment of an inner blade of the rotary electric shaver illustrated in FIG. 1.

Here, a configuration of the inner blade 42 will be described in more detail. As illustrated in FIG. 3, the inner blade 42 according to the present embodiment is configured to include a plurality of small blades 42A obtained by erecting a portion of a metal plate from a plate surface 42B (in order to simplify the drawing, the reference number is given to only some small blades). As an example, the inner blade 42 is formed in such a way that the metal plate formed of stainless steel is used and the metal plate is subjected to die cutting and bending through press working. In FIG. 3, a rotation direction of the inner blade 42 is indicated by an arrow direction. A front side in the rotation direction is indicated by the reference number F, and a rear side in the rotation direction is indicated by the reference numeral number R (the same as above in other drawings). According to the present embodiment, the inner blade 42 employs an integral structure using the metal plate. However, without being limited thereto, a portion of the plate surface and a portion of the small blade may be a separate structure, for example.

As an example, the small blade 42A according to the present embodiment has a substantially cylindrical shape having a rectangular cross section in which one side is approximately 1 mm and the other side is approximately 0.5 mm, and is formed so that a length L2 is-approximately 2 mm. However, the small blade 42A is not limited to this dimensional shape.

Figure 4A:
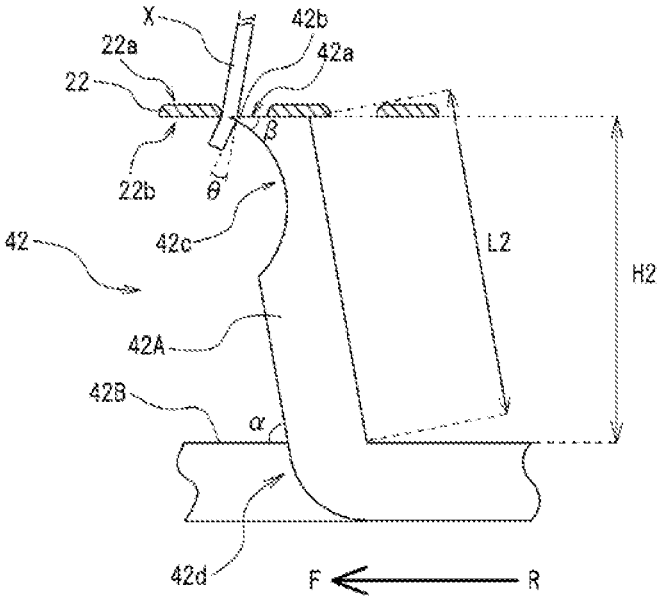
FIGS. 4A and 4B are respectively a schematic view illustrating a configuration example of the inner blade and an outer blade of the rotary electric shaver illustrated in FIG. 1 and a state where hair X is cut, and a schematic view illustrating a state of the cut hair X.
Figure 4B:
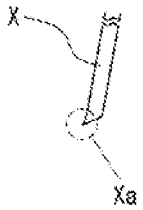

In addition, the small blade 42A is formed by being erected so that an angle (erecting angle) $\alpha$ of the front side in the rotation direction with respect to the plate surface 42B of the metal plate becomes an acute angle (in the present embodiment, $45° \leq \alpha \leq 90°$ (refer to FIGS. 3, 4A, and 4B). Here, FIG. 4A is a view illustrating a configuration example of the inner blade 42 and the outer blade 22 of the rotary electric shaver according to the present embodiment and a state when hair X is cut. FIG. 4B is a view illustrating a state where the hair X is cut by the inner blade 42. The present embodiment will be described on the assumption that the respective small blades 42A of the inner blade 42 have the same configuration. However, the small blades 42A are not limited to the same configuration. For example, a modification example may be conceivable so that an inner peripheral side and an outer peripheral side have mutually different configurations.

Figure 8A:
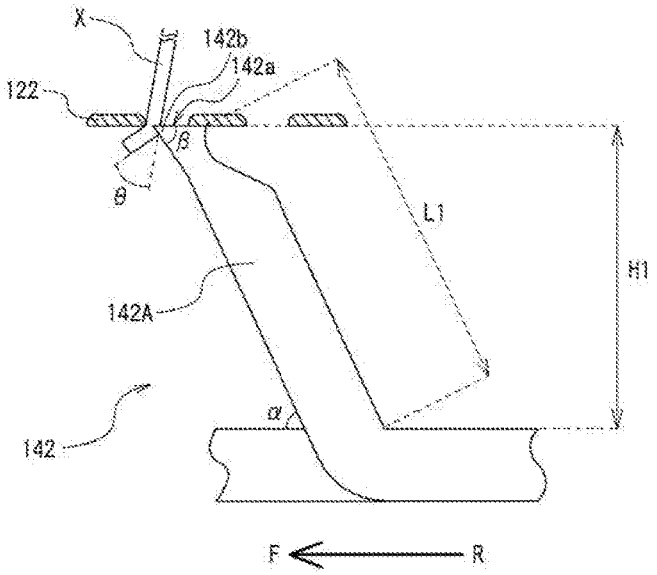
FIG.8A PRIOR ART
FIGS. 8A and 8B are respectively a schematic view illustrating a configuration example of an inner blade and an outer blade of a rotary electric shaver according to an embodiment in the related art and a state where the hair X is cut, and a schematic view illustrating a state of the cut hair X.
Figure 8B:
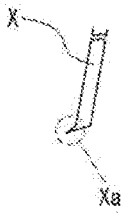
FIG.8B PRIOR ART
Figure 9:
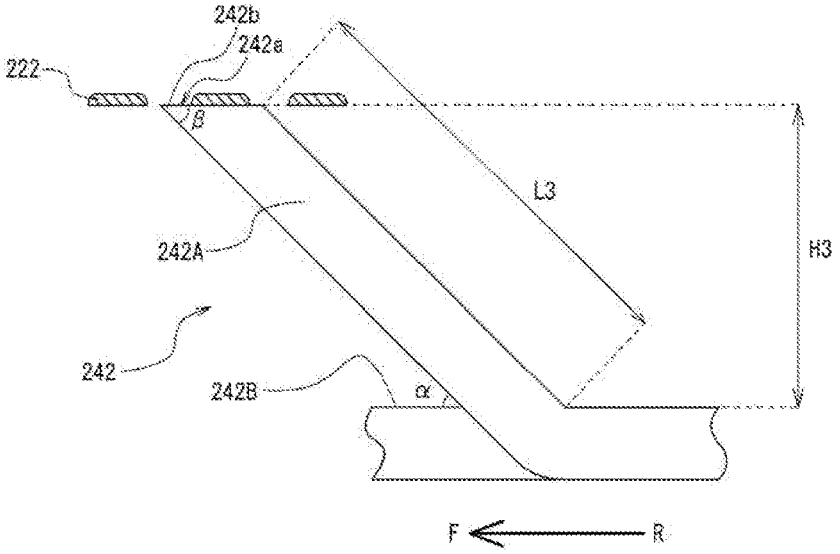
FIG.9 PRIOR ART
FIG. 9 is a schematic view illustrating an example of an inner blade of a rotary electric shaver according to a first comparative example.

As illustrated in FIGS. 4A and 4B, according to the above-described configuration, the erecting angle $\alpha$ can be set to be larger compared to a configuration (FIGS. 8A and 8B) in the related art (as an example, whereas the erecting angle $\alpha$ illustrated in FIGS. 8A and 8B shows $\alpha=60°$, the erecting angle $\alpha$ illustrated in FIGS. 4A and 4B shows $\alpha=80°$). That is, compared to the configuration in the related art, a configuration can be adopted in which the length L2 is shortened without changing the height H2 of the small blade 42A (that is, while the height H2 is maintained to be the same dimension as the height H1). As a result, it is possible to improve rigidity of the small blade 42A, and it is possible to prevent deflection or vibrations during the operation. Accordingly, it is possible to realize a state where the sliding surface (upper end surface 42*a* of the small blade 42A) of the inner blade 42 is stably brought into close contact with the outer blade 22 (lower surface 22*b*). Therefore, since the hair can be sufficiently captured, deep shaving can be performed. The hair is not pulled, thereby achieving an advantageous effect in that a user feels very satisfactory shaving comfortability.

In addition, compared to the configuration in the related art, the height H2 of the small blade 42A is not lowered. Therefore, it is also possible to solve the problem that a clearance cannot be ensured.

Furthermore, compared to the configuration in the related art, the erecting angle $\alpha$ is set to be larger, thereby decreasing an area of a cross section made by a plane parallel to the rotation direction of the small blade 42A. Accordingly, it is possible to decrease an area of the upper end surface 42*a* formed by polishing the upper end portion of the small blade 42A. As a result, sliding resistance can be decreased by decreasing the area of the sliding surface (upper end surface 42*a* of the small blade 42A) against the outer blade 22 (lower surface 22*b*). Therefore, it is possible to reduce noise (sliding sound), and it is possible to reduce power consumption.

Figure 10:
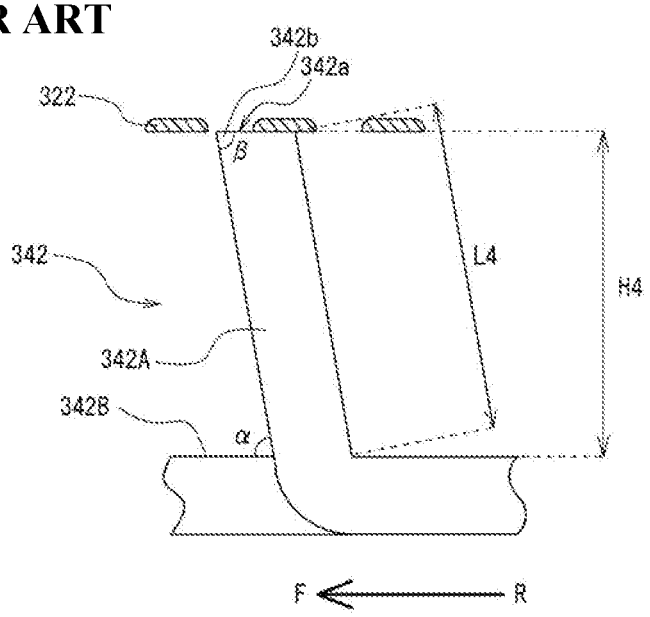
FIG.10 PRIOR ART
FIG. 10 is a schematic view illustrating an example of an inner blade of a rotary electric shaver according to a second comparative example.

However, as an inner blade 342 according to a second comparative example, if the erecting angle $\alpha$ is set to be larger as illustrated in FIG. 10, a length L4 and a height H4 of a small blade 342A are shortened. However, a rake angle $\beta$ increases, thereby increasing an angle $\alpha$. Consequently, as described above, conflicting problem arises in that remaining hair is likely to appear on one end side of the cross section of the hair.

As illustrated in FIGS. 4A and 4B, in order to solve the problem, the small blade 42A of the inner blade 42 according to the present embodiment has a configuration in which a concave portion 42*c* having a shape hollowed toward a lower end portion 42*d* from the upper end surface 42*a* which comes into sliding contact with the outer blade 22 (lower surface 22*b*) is disposed on the front side in the rotation direction. In this manner, in the small blade 42A, an upper end edge 42*b* defined by the upper end surface 42*a* and the concave portion 42*c* functions as a blade edge for cutting the hair.

According to this configuration, the angle (rake angle) $\beta$ of the blade edge (that is, the upper end edge 42*b*) of the small blade 42A can be formed to be an acute angle (in the present embodiment, $15° \leq \beta \leq 40°$). That is, the rake angle $\beta$ of the blade edge 42*b* of the small blade 42A can be decreased. Accordingly, when the hair X entering the hair inlets of the outer blade 22 is cut, the hair X is pushed by a lower wall of the blade edge 42*b*, thereby achieving an advantageous effect that the angle $\theta$ to be pushed up can be decreased. Therefore, when the hair X is cut, it is possible to prevent the remaining hair Xa from appearing on one end side of the cross section of the hair X. At the same time, it is possible to prevent the hair X from being pulled. Accordingly, it is possible to prevent shaving comfortability from becoming poor by restraining skin irritation.

Figure 5:
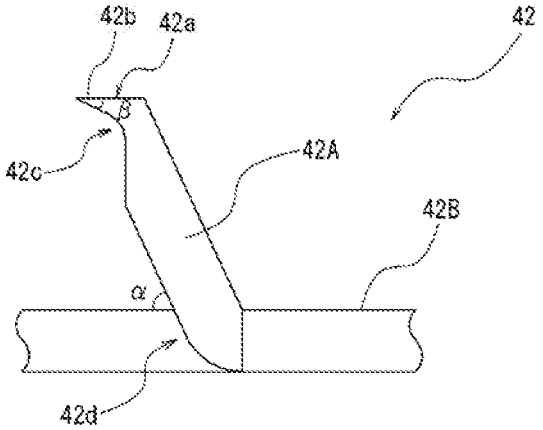
FIG. 5 is a schematic view illustrating a modification example of a small blade of the inner blade of the rotary electric shaver illustrated in FIG. 1.

The shape of the concave portion 42*c* is not particularly limited. For example, the overall concave portion 42*c* may be formed in a curve shape as in the example illustrated in FIGS. 4A and 4B. Alternatively, as in a modification example illustrated in FIG. 5, a shape may be employed in which the concave portion 42*c* is configured to include a plurality of (for example, two) planes and a curve connecting the planes.

Here, although a method of forming the concave portion 42*c* is not particularly limited, the concave portion 42*c* can be formed using various processing methods such as pressing, cutting (grinding), electric discharge processing, and electrochemical machining (ECM).

As a processing procedure of the small blade 42A, it is preferable to perform a step of forming the upper end surface 42*a* through polishing after performing a step of forming the concave portion 42*c*. The small blade 42A is processed in accordance with this step procedure, thereby enabling a distal end portion of the blade edge (upper end edge 42*b*) to have a sharp shape whose vertical thickness is 20 μm or smaller and a shape having no burr.

Figure 6:
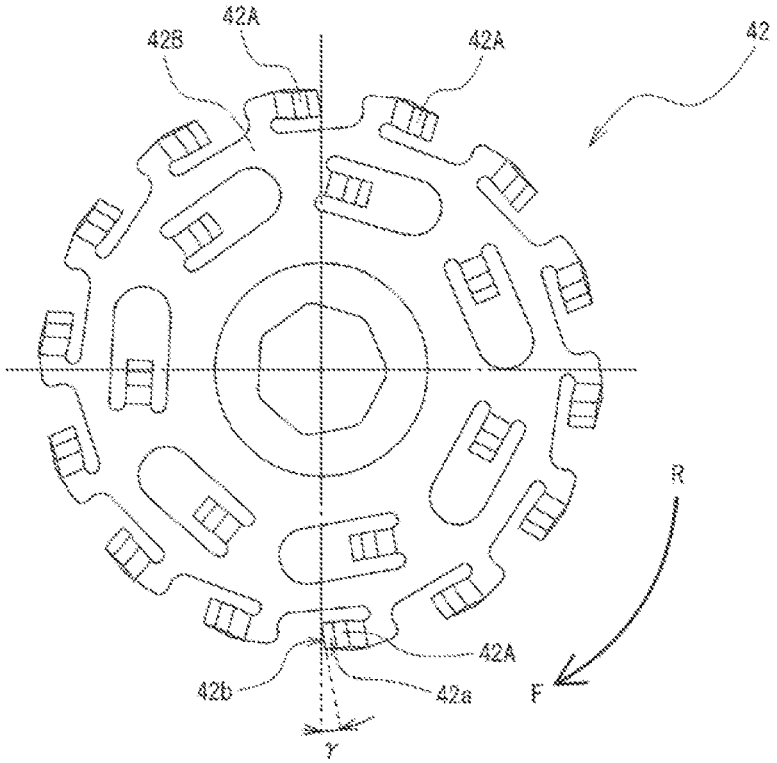
FIG. 6 is a schematic view (plan view) of the inner blade of the rotary electric shaver illustrated in FIG. 3.

In addition, as illustrated in a plan view of FIG. 6, the small blade 42A may be formed in a shape in which the blade edge (upper end edge 42*b*) has an angle (hereinafter, referred to as a "pinching angle") $\gamma$ with respect to a line (plane) connecting the central axis and the blade edge to each other. According to this configuration, the pinching angle $\gamma$ is formed to be a predetermined angle which is larger than 0°. Therefore, hair cutting performance is improved, thereby enabling a user to feel shaving comfortability.

Second Embodiment

Subsequently, the inner blade 42 of the rotary electric shaver according to a second embodiment of the present invention will be described. The inner blade 42 according to the present embodiment has a basic configuration which is the same as that of the above-described first embodiment, but particularly has a different point in a configuration of the small blade 42A. Hereinafter, the present embodiment will be described by mainly describing the different point.

Figure 7:
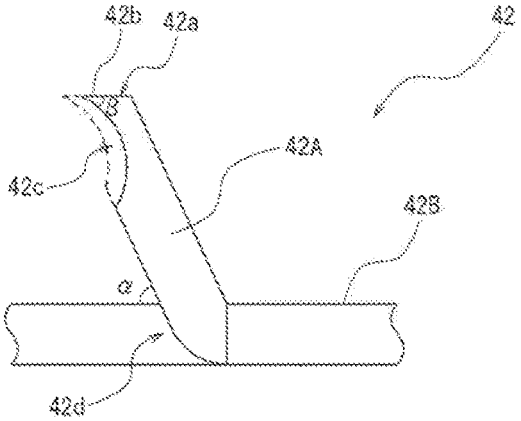
FIG. 7 is a schematic view illustrating a second embodiment of the inner blade of the rotary electric shaver illustrated in FIG. 1.

As illustrated in FIG. 7, the small blade 42A of the inner blade 42 according to the present embodiment has a configuration in which the concave portion 42*c* is disposed therein so that a length dimension in the rotation direction of the upper end surface 42*a* is shorter than a length dimension in the rotation direction at a position having no concave portion 42*c*. In this way, a position to be hollowed is deepened, thereby adopting a configuration in which a position of forming the concave portion 42*c* is disposed closer to the rear side in the rotation direction, that is, a configuration in which an area of the upper end surface 42*a* is smaller than an area obtained in a case where the area is only cut by a plane parallel to the rotation direction.

According to this configuration, in addition to the advantageous effect obtained by increasing the erecting angle α according to the above-described first embodiment (reduced area of the sliding surface of the upper end surface 42*a*), it is possible to further achieve an advantageous effect that the area of the sliding surface of the upper end surface 42*a* is much further decreased. Therefore, it is possible to further achieve the advantageous effect of reducing the noise (sliding sound) and the advantageous effect of reducing the power consumption.

Third Embodiment

Subsequently, the inner blade 42 of the rotary electric shaver according to a third embodiment of the present invention will be described. The inner blade 42 according to the present embodiment particularly has the following characteristic in the configuration of the small blade 42A. With regard to the configuration and the operation effect which are the same as those according to the above-described first and second embodiments, repeated description will be omitted.

Figure 11A:
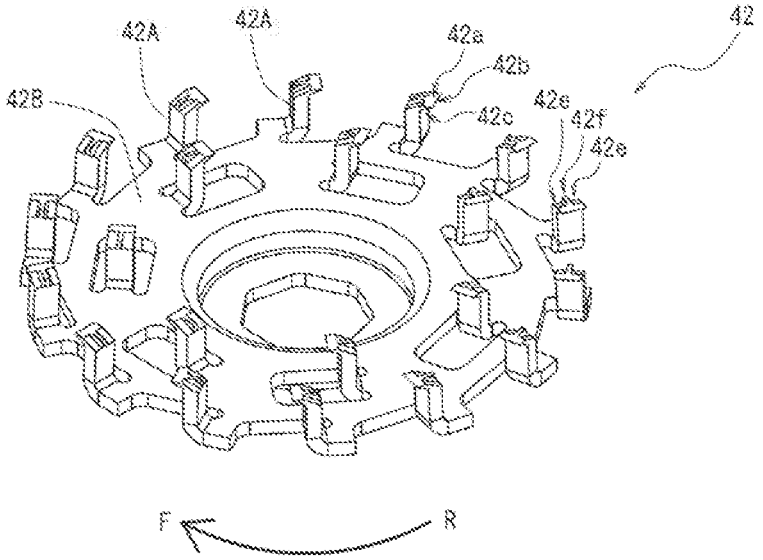
FIGS. 11A and 11B are schematic views illustrating a third embodiment of the inner blade of the rotary electric shaver illustrated in FIG. 1.
Figure 11B:
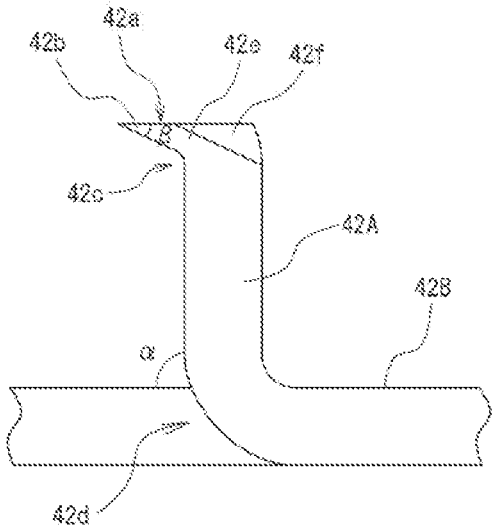

FIG. 11A illustrates a schematic view (perspective view) of the inner blade 42 according to the present embodiment. FIG. 11B illustrates a schematic view (side view) of the small blade 42A of the inner blade 42.

As illustrated in FIGS. 11A and 11B, the small blade 42A of the inner blade 42 according to the present embodiment is formed by erecting a portion of the metal plate so that the angle (erecting angle) a of the front side in the rotation direction with respect to the plate surface 42B of the metal plate satisfies $45° \leq \alpha \leq 135°$, and by bending the upper end portion toward the front side in the rotation direction. In addition, as a bent portion, the concave portion 42*c* is disposed on the front side in the rotation direction. In this way, a configuration is realized in which the erecting angle α is set to be larger. Therefore, it is possible to obtain the same operation effect as that according to the above-described embodiments.

In addition, in the small blade 42A, in an upper end region including the upper end surface 42*a*, a thin portion 42*e* formed by decreasing a region on the rear side in the rotation direction in a cross section (cross section made by a plane parallel to the plate surface 42B of the metal plate) in the rotation direction is formed in a partial region (in the present embodiment, both end positions in the radial direction) in a direction orthogonal to the rotation direction (hereinafter, referred to as the "radial direction"). Correspondingly, as a thick portion 42*f*, a location having no decreased region on the rear side in the rotation direction in the cross section in the rotation direction is formed in a remaining region in the radial direction (in the present embodiment, a central position in the radial direction). That is, the small blade 42A has a configuration in which the thin portion 42*e* is relatively short and the thick portion 42*f* is relatively long in the dimension in the rotation direction. According to the present embodiment, the small blade 42A is formed so that the shape of the upper end surface 42*a* is a shape projecting rearward in the rotation direction (refer to FIG. 11A). As an example, the thin portion 42*e* is formed by means of pressing, but the processing method is not limited thereto.

According to this configuration, in the upper end region of the small blade 42A, the thin portion 42*e* is formed in the partial region in the radial direction. In this manner, it is possible to form a decreased area of the upper end surface 42*a* which is formed by polishing the upper end portion of the small blade 42A, compared to an area obtained in a case where the area is only cut by a plane parallel to the rotation direction. In this way, a configuration having the decreased area of the upper end surface 42*a* of the small blade 42A is realized. Therefore, it is possible to obtain the same operation effect as that according to the above-described embodiments.

Here, if the entire region in the radial direction is formed as the thin portion, rigidity of the upper end portion of the small blade 42A cannot be ensured. In contrast, the present embodiment adopts a configuration in which the thin portion 42*e* is formed in the partial region in the radial direction and in which the thick portion 42*f* is formed in the remaining region. In this manner, the thick portion 42*f* can function as a reinforcement rib. As a result, it is possible to solve the conflicting problem of decreasing the area of the upper end surface 42*a* of the small blade 42A and ensuring the rigidity of the upper end portion of the small blade 42A.

Furthermore, as an advantageous effect obtained through synergy between the above-described configurations, the small blade 42A can be formed so that the angle (rake angle) β of the blade edge (that is, the upper end edge 42*b*) of the small blade 42A becomes an acute angle (in the present embodiment, $15° \leq \beta \leq 40°$). In this way, a configuration is realized in which the rake angle β of the blade edge 42*b* of the small blade 42A is formed to be smaller. Therefore, it is possible to obtain the same operation effect as that according to the above-described embodiments.

Fourth Embodiment

Figure 12A:
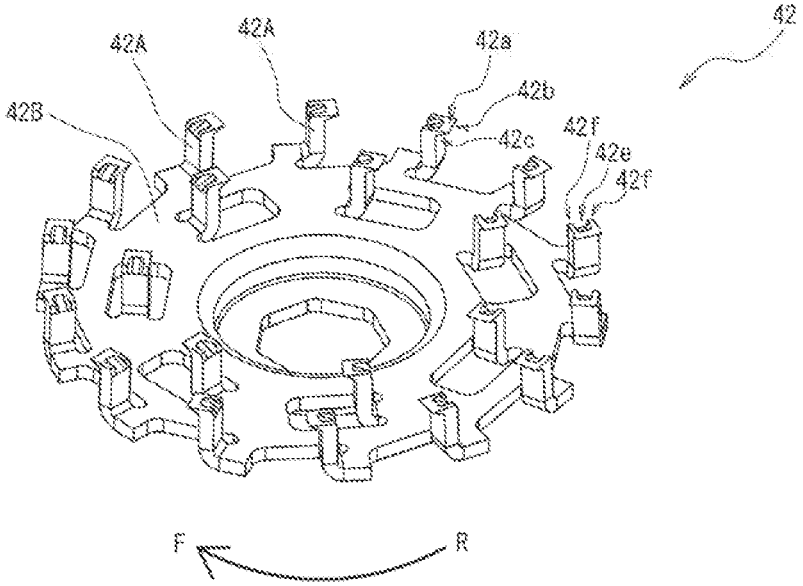
FIGS. 12A and 12B are schematic views illustrating a fourth embodiment of the inner blade of the rotary electric shaver illustrated in FIG. 1.
Figure 12B:
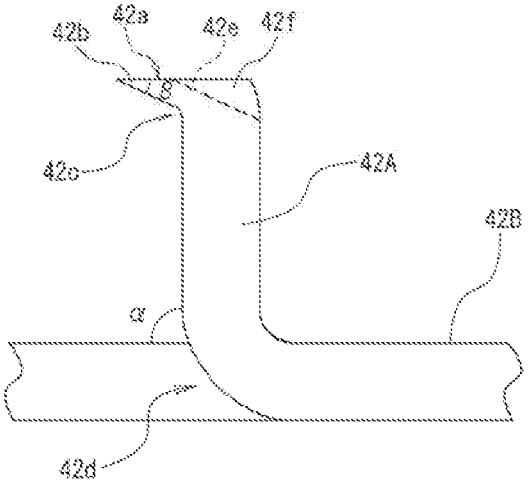

Subsequently, the inner blade 42 of the rotary electric shaver according to a fourth embodiment of the present invention will be described. Here, FIG. 12A illustrates a schematic view (perspective view) of the inner blade 42 according to the present embodiment. FIG. 12B illustrates a schematic view (perspective view) of the small blade 42A of the inner blade 42.

The inner blade 42 according to the present embodiment has a basic configuration which is the same as that of the above-described third embodiment, but particularly has a different point in a configuration of the small blade 42A. Hereinafter, the present embodiment will be described by mainly describing the different point.

In the small blade 42A according to the present embodiment, an arrangement position of the thin portion 42*e* and the thick portion 42*f* which are formed in the upper end region including the upper end surface 42*a* is reversely located compared to that according to the above-described third embodiment. That is, a configuration is adopted in which the thin portion 42*e* is formed at the central position in the radial direction and the thick portion 42*f* is formed at both end positions in the radial direction. That is, the small blade 42A is formed so that the shape of the upper end surface 42*a* is a shape recessed rearward in the rotation direction (refer to FIG. 12A). Therefore, this configuration can also obtain the same operation effect as that according to the above-described third embodiment.

As described above, according to the inner blade of the rotary electric shaver in the present invention, it is possible to solve the conflicting problem of decreasing the rake angle β and increasing the erecting angle α in the small blade. That is, it is possible to decrease the rake angle β of the blade edge of the small blade. Accordingly, when the hair is cut, an advantageous effect can be obtained in that it is possible to decrease the angle θ for pushing up the hair. Therefore, when the hair is cut, it is possible to prevent remaining hair from appearing on one end side in the cross section of the hair. At the same time, it is possible to increase the erecting angle α of the small blade. Thus, it is possible to obtain an advantageous effect that it is possible to decrease the area of the sliding surface of the upper end surface 42*a* of the small blade. Therefore, it is possible to reduce the sliding resistance against the outer blade 22 (22*b*), and it is possible to reduce both the noise (sliding sound) and the power consumption.

Without being limited to the above-described embodiments, the present invention can be modified in various ways within the scope not departing from the present invention. In particular, the rotary electric shaver having three sets of combination (blade unit) between the outer blade and the inner blade has been described as an example. However, the present invention is not limited thereto.

What is claimed is:

1. An inner blade of a rotary electric shaver which includes an outer blade whose upper surface functions as an annular shaving surface having multiple hair inlets;

the inner blade having a plurality of small blades which rotate while coming into sliding contact with a lower surface of the outer blade, wherein each of the small blades is formed by erecting a portion of a metal plate so that an angle α on a front side of each of the small blades in a rotation direction with respect to a plate surface of the metal plate satisfies $45° \leq \alpha \leq 135°$ and by bending an upper end portion of each of the small blades towards the front side of each of the small blades in the rotation direction, and the front side of each of the small blades in the rotation direction has a concave portion as a bent portion, and an upper end region of each of the small blades includes an upper end surface, a thin portion formed by decreasing a region on a rear side of each of the small blades in the rotation direction, said thin portion is formed at both end positions in a radial direction of each of the small blades, said radial direction being orthogonal to the rotation direction, and a thick portion is formed at a central position between both end positions.

2. The inner blade of a rotary electric shaver according to claim 1, wherein the thick portion on each of the small blades is substantially on the same plane as the upper end surface and is centrally positioned relative to each of the small blades.

3. The inner blade of a rotary electric shaver according to claim 1, wherein each of a first plurality of the small blades are spaced relative to each other and are arranged along a first circumferential circle radially disposed outwardly from a central axis of the inner blade.

4. The inner blade of a rotary electric shaver according to claim 3, wherein each of a second plurality of the small blades are spaced relative to each other and are arranged along a second circumferential circle concentric with the first circumferential circle and radially disposed outwardly from the first circumferential circle and radially disposed outwardly from the central axis of the inner blade.

* * * * *